US012529270B1

(12) United States Patent
Garza et al.

(10) Patent No.: US 12,529,270 B1
(45) Date of Patent: Jan. 20, 2026

(54) CONNECTOR ASSEMBLY WITH TANDEM-ACTING LOCKING ASSEMBLIES

(71) Applicant: FMC Technologies, Inc., Houston, TX (US)

(72) Inventors: Jose Angel Garza, Spring, TX (US); Roman Chirko, Tomball, TX (US); Joshua Duane Douglas, Pearland, TX (US); Richard Adam Bridwell, Houston, TX (US); Yaguan Ji, Surry (CA)

( * ) Notice: Subject to any disclaimer, the term of this patent is extended or adjusted under 35 U.S.C. 154(b) by 0 days.

(21) Appl. No.: 18/907,044

(22) Filed: Oct. 4, 2024

(51) Int. Cl.
*E21B 17/046* (2006.01)

(52) U.S. Cl.
CPC ..... *E21B 17/0465* (2020.05)

(58) Field of Classification Search
CPC ..... E21B 33/03; E21B 33/038
See application file for complete search history.

(56) References Cited

U.S. PATENT DOCUMENTS

| | | | | |
|---|---|---|---|---|
| 3,405,956 | A * | 10/1968 | Pierce, Jr. | E21B 33/04 285/321 |
| 4,606,557 | A | 8/1986 | Coffey | |
| 4,650,226 | A * | 3/1987 | Babbitt | E21B 33/04 285/348 |
| 5,332,043 | A | 7/1994 | Ferguson | |
| 7,604,050 | B2 | 10/2009 | Dallas et al. | |
| 9,637,993 | B2 | 5/2017 | Nguyen et al. | |
| 9,765,582 | B2 | 9/2017 | Vanderford et al. | |
| 10,156,112 | B2 | 12/2018 | Cotton et al. | |
| 2002/0070545 | A1* | 6/2002 | Meek | E21B 33/03 285/123.9 |
| 2011/0095526 | A1* | 4/2011 | Vanderford | E21B 33/04 29/525.11 |

FOREIGN PATENT DOCUMENTS

| | | | |
|---|---|---|---|
| CN | 114991698 | B | 9/2022 |
| WO | WO 2021/002809 | A2 | 1/2021 |

* cited by examiner

*Primary Examiner* — David Carroll

(57) ABSTRACT

A connector assembly for securing a first hydrocarbon production system component to a second hydrocarbon production system component which in turn is connected to a wellbore includes a tubular connector body having a first end which is connectable to the first component, an opposite second end, a connector bore which extends axially between the first and second ends, and a cylindrical recess which extends through the second end coaxially with the connector bore and is configured to receive an upper end portion of the second component. The connector assembly further includes a plurality of locking assemblies for securing the connector body to the second component. Each locking assembly includes a locking segment which is configured to engage a locking profile on the second component to thereby secure the connector body to the second component, an outer lock screw which is threadedly received in a corresponding through hole in the connector body, and an inner lock screw which is threadedly received in a through bore in the outer lock screw. In operation, rotation of the outer lock screw operates to move the locking segment a first distance into the locking groove, and rotation of the inner lock screw relative to the through bore in the outer lock screw operates to move the locking segment an additional second distance into engagement with the locking groove.

15 Claims, 11 Drawing Sheets

CONNECTOR ASSEMBLY WITH TANDEM-ACTING LOCKING ASSEMBLIES

FIELD OF THE DISCLOSURE

The present disclosure is directed to a connector assembly for securing a first hydrocarbon production system component to a second hydrocarbon production system component connected to a wellbore. More particularly, the disclosure is directed to such a connector assembly having a plurality of locking assemblies which each include a tubular outer lock screw for driving a locking segment a first distance into engagement with a corresponding locking groove on the second production system component, and a smaller diameter inner lock screw, positioned coaxially within the outer lock screw, for driving the locking segment an additional second distance into engagement with the locking groove. In this manner, the outer lock screw can be torqued to draw the connector assembly and the second production system component together to partially energize the primary sealing member between the connector assembly and the second production system component, and the inner lock screw can be torqued to fully energize the primary sealing member and preload the connection. Thus, the locking assembly is able to generate sufficient connecting force to both energize the primary sealing member and rigidize the connection without the need for powered torque tools.

BACKGROUND OF THE DISCLOSURE

Mechanical connector assemblies are commonly used to secure a first hydrocarbon production system component, such as a blowout preventer (BOP), to a second hydrocarbon production system component connected to a wellbore, such as a wellhead. The connector assembly is usually connected to the BOP using a relatively permanent connection, such as a bolted flange connection, and then the assembly of the BOP and the connector assembly is connected to the wellhead. Some prior art connector assemblies are referred to as quick connectors because the connection between the connector assembly and the wellhead is designed to be made up relatively quickly (for example, more quickly than the connection between the connector assembly and the BOP).

Some prior art connector assemblies include a connector body having a first end which is connectable to the BOP, a second end which is connectable to the wellhead, a connector bore which extends axially between the first and second ends, and a recess which extends axially through the second end and is configured to receive an upper end portion of the wellhead. In use, the connector bore connects the wellbore to the BOP and any equipment connected to the top of the BOP. Thus, a primary sealing member, such as an API ring type joint (RTJ) gasket, is normally positioned between the connector body and the wellhead in order to prevent wellbore pressure from escaping into the environment.

Certain prior art connector assemblies are secured to the wellhead using a plurality of locking assemblies arranged circumferentially around the connector body. These locking assemblies may include a lock screw which is threadedly received in a corresponding through hole in the connector body and a locking segment which is connected to a radially inner end of the lock screw and is configured to engage a corresponding locking groove on the wellhead. In use, once the connector body is landed on the wellhead, the lock screws are torqued in order to drive the locking segments into the locking groove and thereby secure the connector body to the wellhead.

Typically, the lock screws must be torqued sufficiently to both energize the primary sealing member and rigidize the connection (that is, preload the locking segments against the locking groove) in order to withstand the often significant bending forces generated by equipment connected to the top of the connector assembly. These actions normally require that the lock screws be torqued to levels which cannot be achieved with hand tools. Rather, achieving the necessary torques often requires that powered torque drivers or impact wrenches be used to secure the connector assembly to the wellhead. However, these powered tools are not always available in the field when the connection needs to be made up. As a result, significant time can be lost in procuring the proper tools to make up the connection.

SUMMARY OF THE DISCLOSURE

In accordance with the present disclosure, a connector assembly is provided for securing a first hydrocarbon production system component to a second hydrocarbon production system component which in turn is connected to a wellbore. The connector assembly comprises a tubular connector body having a first end which is connectable to the first component, an opposite second end, a connector bore which extends axially between the first and second ends, and a cylindrical recess which extends through the second end coaxially with the connector bore and is configured to receive an upper end portion of the second component.

The connector assembly also includes a plurality of locking assemblies for securing the connector body to the second component. Each locking assembly comprises a locking segment which is configured to engage a locking profile on the second component to thereby secure the connector body to the second component. An outer lock screw is threadedly received in a corresponding through hole in the connector body such that rotation of the outer lock screw in the through hole results in axial translation of the outer lock screw relative to the connector body. The outer lock screw comprises a radially outer first end, a radially inner second end, and a through bore which extends axially between the first and second ends. The outer lock screw is operatively engaged with the locking segment such that axial translation of the outer lock screw radially inwardly relative to the connector body results in movement of the locking segment radially inwardly relative to the locking profile.

An inner lock screw is threadedly received in the through bore in the outer lock screw such that rotation of the inner lock screw relative to the through bore results in axial translation of the inner lock screw relative to the outer lock screw. The inner lock screw comprises a radially outer first end and a radially inner second end and is operatively engaged with the locking segment such that axial translation of the inner lock screw radially inwardly relative to the outer lock screw results in movement of the locking segment radially inwardly relative to the locking profile. In operation rotation of the outer lock screw relative to the through hole in the connector body operates to move the locking segment a first distance into the locking groove, and rotation of the inner lock screw relative to the through bore in the outer lock screw operates to move the locking segment an additional second distance into engagement with the locking groove.

In accordance with one aspect of the disclosure, the inner lock screw may be operatively engaged with the locking segment through a retainer member which is positioned between the second end of the inner lock screw and the locking segment.

In accordance with another aspect of the disclosure, the retainer member may be slidably received in a cylindrical recess formed in the second end of the outer lock screw.

In accordance with yet another aspect of the disclosure, the retainer member may be connected to the locking segment.

In accordance with a further aspect of the disclosure, the retainer member may be connected to the locking segment by a slot and key arrangement comprising a key which extends axially from a radially inner end of the retainer member and a slot which extends partially through the locking segment generally transverse to the axis of the locking assembly.

In accordance with one aspect of the disclosure, the retainer member may be axially movably connected to the outer lock screw.

In accordance with another aspect of the disclosure, the retainer member may be axially movably connected to the outer lock screw with a set screw secured to the retainer. According to this aspect, the set screw may comprise a head which, when the retainer is assembled with the outer lock screw, is positioned in an oblong aperture formed in the second end of the outer lock screw. The aperture comprises a long axis which is longer than a diameter of the head and is oriented parallel to the axis of the outer lock screw. Accordingly, engagement of the head with the aperture allows axial movement of the retainer relative to the outer lock screw but restricts relative rotation of the retainer relative to the outer lock screw.

In accordance with yet another aspect of the disclosure, the second end of the inner lock screw may be connected to the retainer member.

In accordance with a further aspect of the disclosure, the second end of the inner lock screw may be connected to the locking segment by a slot and key arrangement comprising a key which extends axially from the second end of the inner lock screw and a slot which extends partially through the locking segment generally transverse to the axis of the locking assembly.

The present disclosure is also directed to a method for securing a first hydrocarbon production system component to a second hydrocarbon production system component which in turn is connected to a wellbore. The method comprises the steps of providing a connector assembly having a tubular connector body, a plurality of locking segments which are radially slidably supported on the connector body, a plurality of outer lock screws which are each received in a corresponding radially extending through hole in the connector body, and a plurality of inner lock screws which are each received in an axial through bore in a corresponding outer lock screw; connecting a first end of the connector body to the first component; positioning a second end of the connector body over an upper end portion of the second component; and moving each locking segment into a locking profile on the second component to thereby secure the connector body to the second component. In this embodiment, the step of moving each locking segment into the locking profile comprises first moving the outer lock screw axially radially inwardly relative to the through hole to thereby move the locking segment a first distance into engagement with the locking profile, and then moving the inner lock screw axially radially inwardly relative to the outer lock screw to thereby move the locking segment an additional second distance into engagement with the locking profile.

In accordance with one aspect of the disclosure, each outer lock screw may be threadedly received in its corresponding through hole such that rotation of the outer lock screw in the through hole results in axial translation of the outer lock screw relative to the connector body. Further, each inner lock screw may be threadedly received in its corresponding through bore such that rotation of the inner lock screw relative to the through bore results in axial translation of the inner lock screw relative to the outer lock screw.

In accordance with another aspect of the disclosure, each inner lock screw may be operatively engaged with its corresponding locking segment through a retainer member positioned in the through bore between a radially inner end of the inner lock screw and the locking segment.

In accordance with yet another aspect of the disclosure, each retainer member may be connected to its corresponding locking segment.

In accordance with a further aspect of the disclosure, each retainer member may be axially movably connected to its corresponding outer lock screw.

In accordance with yet another aspect of the disclosure, the retainer member may be axially movably connected to the outer lock screw using a set screw secured to the retainer. The set screw may comprise a head which, when the retainer is assembled with the outer lock screw, is positioned in an oblong aperture formed in a radially inner end of the outer lock screw. The aperture may comprise a long axis which is longer than a diameter of the head and is oriented parallel to the axis of the outer lock screw. Accordingly, engagement of the head with the aperture allows axial movement of the retainer relative to the outer lock screw but restricts relative rotation of the retainer relative to the outer lock screw.

Thus, the locking assembly according to the present disclosure employs tandem acting outer and inner lock screws to generate the connecting force required to fully energize the primary sealing member and preload the locking segments against the locking groove. Since the axial force generated by the inner lock screw is inversely proportional to the diameter of the lock screw, the inner lock screw is capable of generating a greater connecting force than the outer lock screw for a given torque. This mechanical advantage enables the required connecting force to be achieved without the need to apply relatively large torques to either the outer lock screw or the inner lock screw. As a result, the primary sealing member can be fully energized, and the connection rigidized without the need for power tools such as torque drivers and impact wrenches.

These and other objects and advantages of the present disclosure will be made apparent from the following detailed description, with reference to the accompanying drawings.

DETAILED DESCRIPTION OF THE DISCLOSURE

Figure 1:
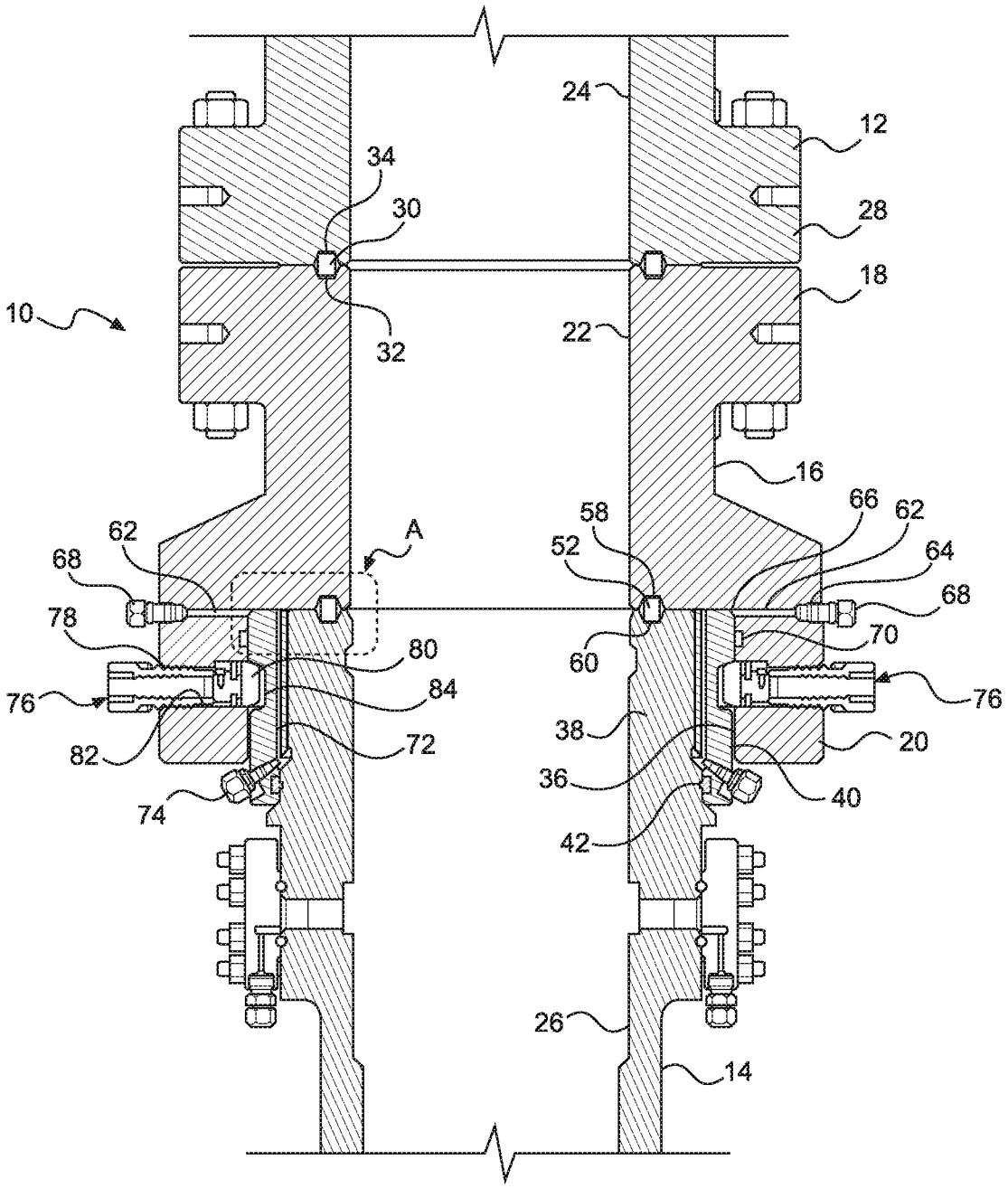
FIG. 1 is a cross-sectional representation of an illustrative embodiment of a connector assembly of the present disclosure shown being used to connect a first hydrocarbon production system component to an example of a second hydrocarbon production system component.

The present disclosure is directed to a connector assembly for connecting a first hydrocarbon production system component to a second hydrocarbon production system component which in turn is connected to a wellbore. The first component may comprise, for example, part of a pressure control string used in the drilling, completion, and/or servicing of a hydrocarbon well, an injection well, or a carbon sequestration well. Accordingly, the pressure control string may comprise a pressure control component, such as a blowout preventer (BOP), and the connector assembly may be used to connect the BOP to the second component. The second component may comprise any equipment which is usually connected to a wellbore. For example, the second component may comprise a wellhead, a christmas tree, or a tubing spool.

In accordance with a certain embodiments of the present disclosure, the connector assembly includes a tubular connector body having a first end which is connectable to the first component, a second end which is connectable to the second component, a connector bore which extends axially between the first and second ends, and a cylindrical recess which extends through the second end coaxially with the connector bore and is configured to receive an upper end portion of the second component.

In accordance with certain embodiments of the disclosure, the connector assembly may also include a plurality of locking assemblies for releasably securing the connector body to the second component. Each locking assembly may include a lock screw and a locking segment. Each lock screw may be positioned in a corresponding through hole which extends through the connector body to the recess. The locking segment may be operatively connected to a radially inner end of the lock screw and may be configured to engage a corresponding locking profile on the second component. In some embodiments, the lock screw may be threadedly received in the through hole such that rotation of the lock screw relative to the through hole will result in axial translation of the lock screw, and thus the locking segment, relative to the connector body.

In certain embodiments of the disclosure, the lock screw may form part of a screw assembly comprising an outer lock screw which is threadedly received in the through hole and a smaller diameter inner lock screw which is threadedly received in a through bore that extends axially through the outer lock screw. In this embodiment, the locking segment may be positioned against a radially inner end of the outer lock screw and may be operatively connected to a radially inner end of the inner lock screw. According to this embodiment, the outer lock screw may be rotated to move the locking segment a first distance into engagement with the locking profile, after which the inner lock screw may be rotated relative to the outer lock screw to move the locking segment an additional second distance into engagement with the locking profile. As a result of the mechanical advantage afforded by the smaller diameter of the inner lock screw, the locking assembly is able to generate a substantial connecting force which operates to energize the sealing member (if present) and preload the connector body against the second component to thereby rigidize the connection.

A first illustrative embodiment of a connector assembly according to the present disclosure is depicted in FIG. 1. The connector assembly of this embodiment, which is indicated generally by reference number 10, is shown being used to releasably connect a first hydrocarbon production equipment component 12, such as a BOP (only the lower portion of which is depicted) to a second hydrocarbon production equipment component 14, such as a wellhead (only the upper portion of which is depicted) positioned at the upper end of a wellbore (not shown).

Figure 2:
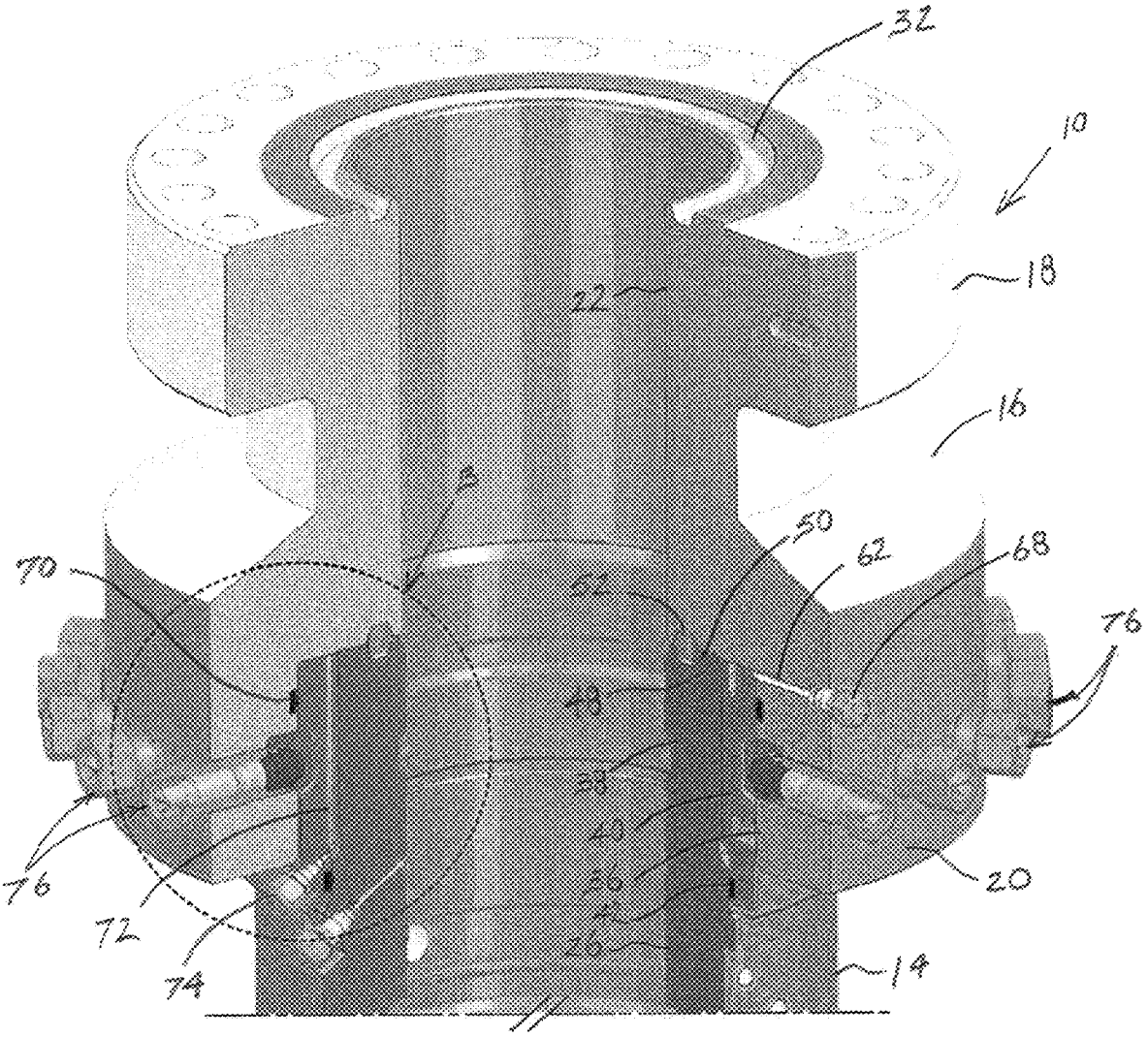
FIG. 2 is a perspective cross-sectional representation of the connector assembly of FIG. 1 shown connected to the second hydrocarbon production system component.
Figure 3:
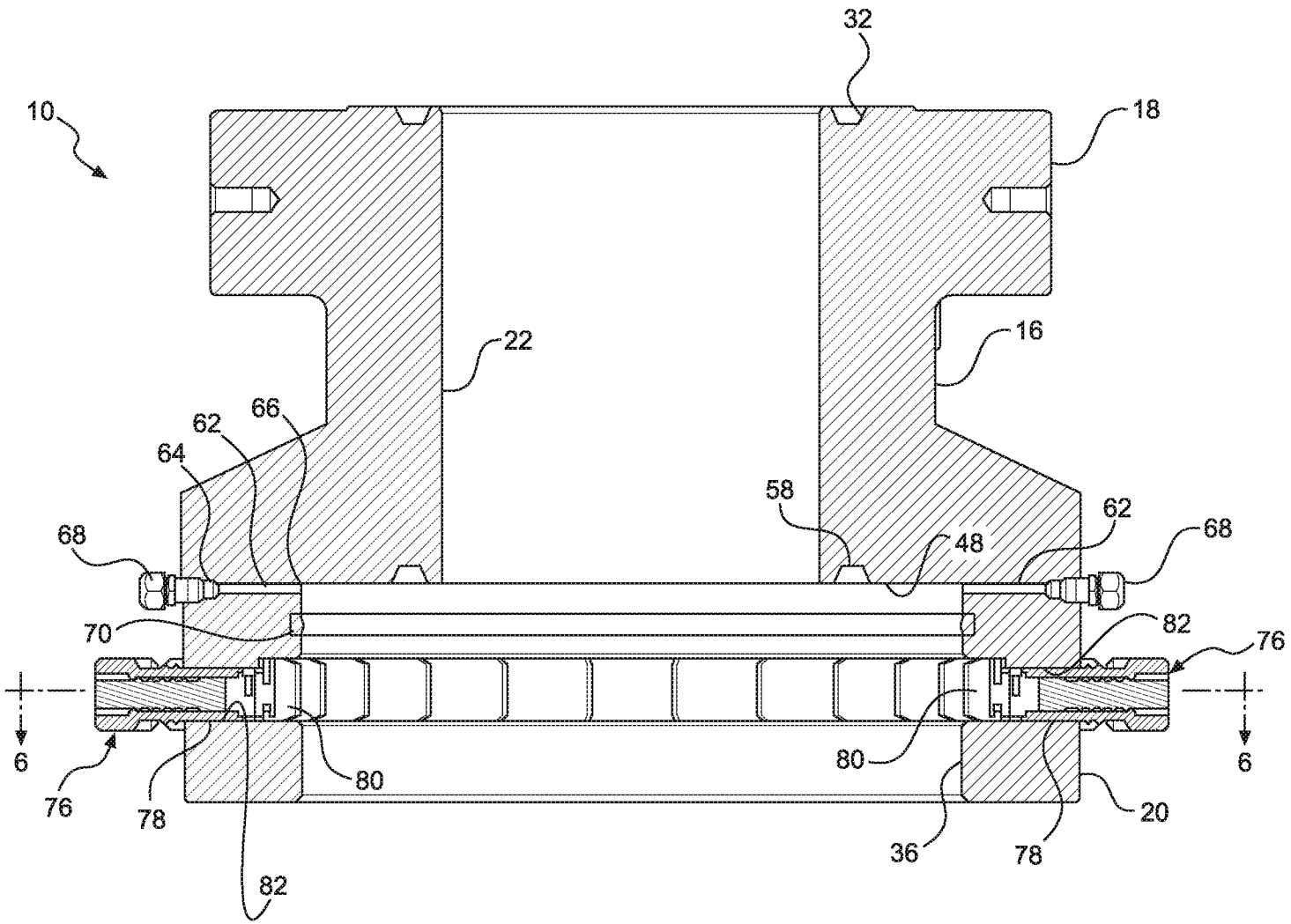
FIG. 3 is an enlarged cross-sectional representation of the connector assembly of FIG. 1.

Referring also to FIGS. 2 and 3, the connector assembly 10 includes a tubular connector body 16 having a first (or upper) end 18, a second (or lower) end 20, and a connector bore 22 which extends axially between the first and second ends. In this example, the BOP 12 includes an axially extending BOP bore 24 and the wellhead 14 includes an axially extending wellhead bore 26, and the connector bore 22 functions to connect the BOP bore to the wellhead bore and, thus, the wellbore.

The first end 18 may be configured to be connected to the BOP 12 by any suitable means. As shown in FIG. 1, for example, the first end 18 is configured as a flange which is bolted to a corresponding flange 28 on the BOP 12. The BOP 12 may be sealed to the connector body 16 using any appropriate sealing member 30. In some embodiments, the sealing member 30 may be positioned in opposing circular seal grooves 32, 34 formed in the first end 18 and the BOP 12, respectively. The sealing member 30 may be similar to the sealing member used to seal the connector assembly 10 to the wellhead 14, which will be described in detail below.

The connector body 16 includes a cylindrical recess 36 which extends axially through the second end 20 coaxially with the connector bore 22 and is configured to receive an upper end portion 38 of the wellhead 14. In certain embodiments the connector assembly 10 is configured to be secured to a separate component which is connected to the upper end portion 38 of the wellhead 14. In this case, the recess 36 may be designed to have a diameter slightly larger than the outer diameter of the component. As shown in FIG. 1, for example, the connector assembly 10 is configured to be secured to a conventional swivel ring 40 which is threaded onto the outer surface of the upper end portion 38 and sealed thereto using a suitable sealing member 42. In this example, the recess 36 is designed to have a diameter slightly larger than the outer diameter of the swivel ring 40.

Figure 4:
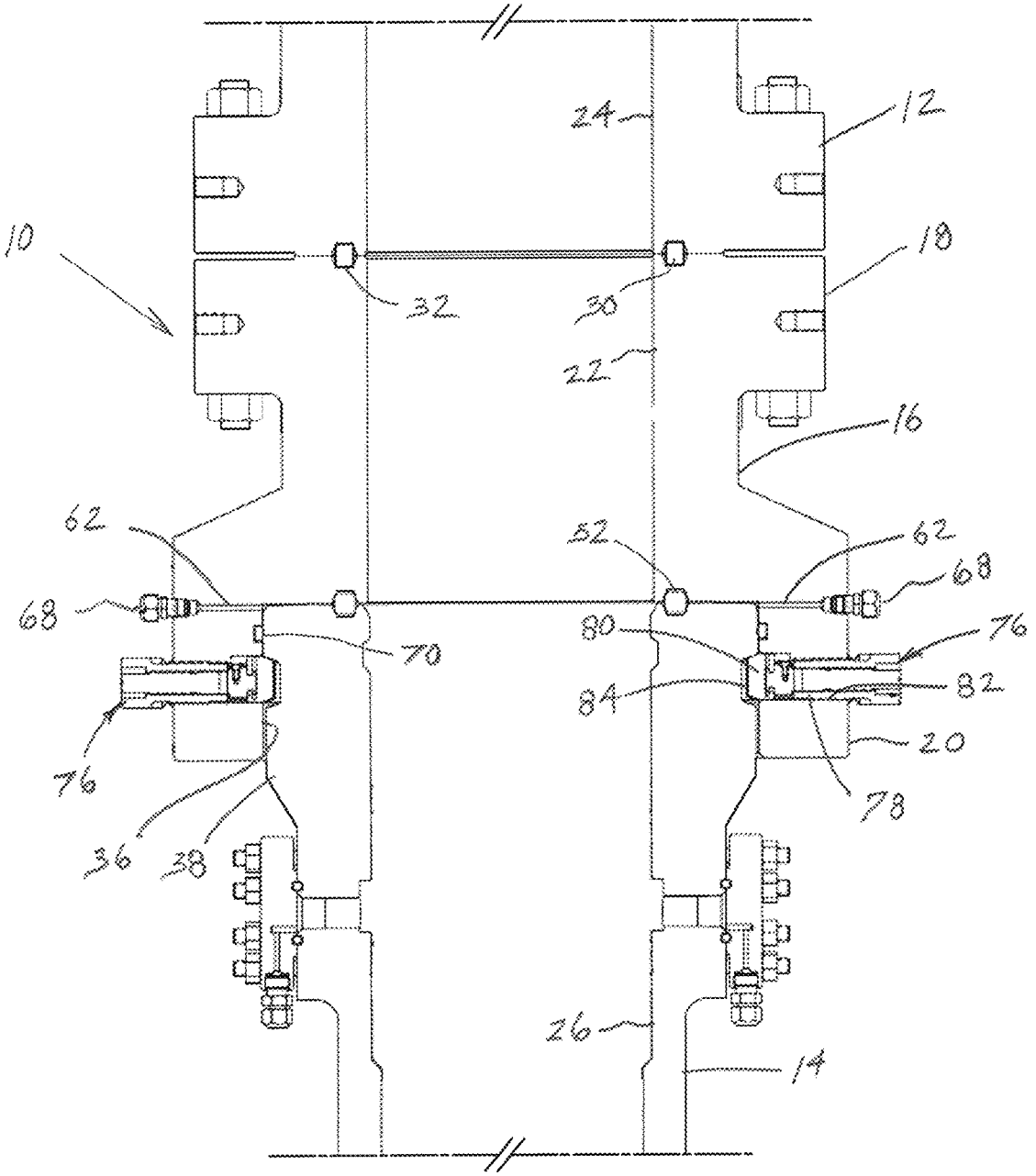
FIG. 4 is a cross-sectional representation of the connector assembly of FIG. 1 being used to connect a first hydrocarbon production system component to another example of a second hydrocarbon production system component.

In an alternative embodiment which is shown in FIG. 4, the wellhead 14 does not include a swivel ring or other component connected to the outer surface of the upper end portion 38. In this example, the connector assembly 10 may be secured directly to the upper end portion 38 of the wellhead 14, in which event the recess 36 may be designed to have a diameter slightly larger than the outer diameter of the upper end portion 38.

Figure 5:
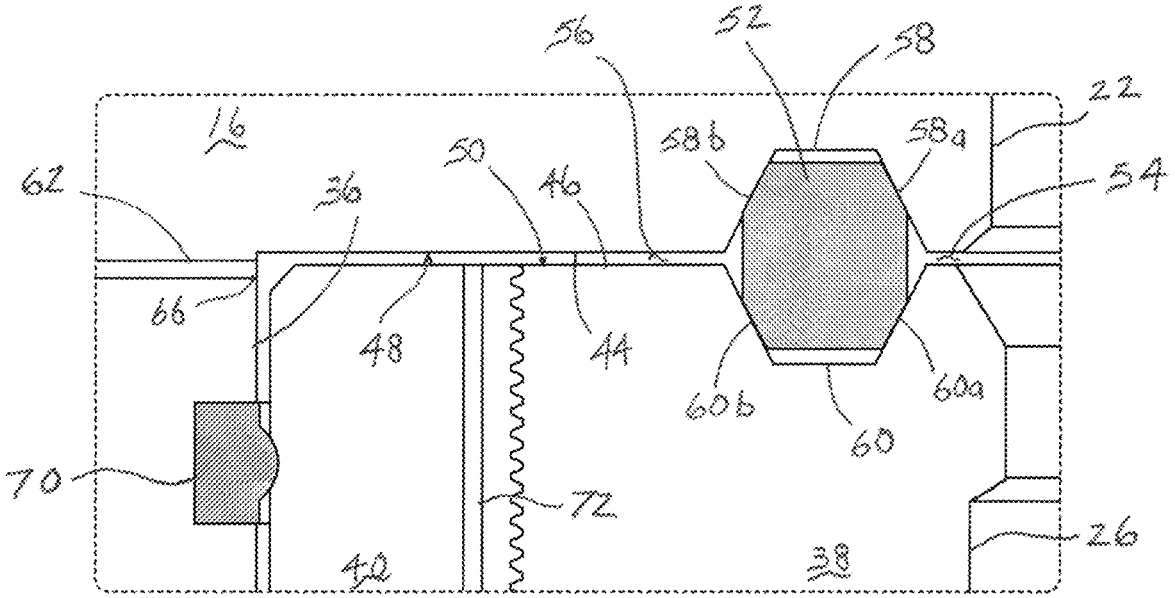
FIG. 5 is an enlarged view of the portion of FIG. 1 designated "A"

Referring also to FIG. 5, which is an enlarged view of the portion of FIG. 1 designated "A", the connector body 16 may include an annular first contact surface 44 which, when the connector assembly 10 is connected to the wellhead 14, is positioned adjacent or against a corresponding second contact surface 46 located on the upper end portion 38 of the wellhead 14. In some embodiments, the first contact surface 44 may be defined by all or part of a shoulder 48 which extends laterally between the connector bore 22 and the larger diameter recess 36. In this example, the second contact surface 46 may be defined by all or part of a laterally extending top end 50 of the wellhead 14. In one example, the first and second contact surfaces 44, 46 may be oriented generally perpendicular to the axis of the connector bore 22.

The connector assembly 10 may be sealed to the wellhead 14 by any suitable sealing member 52, which in certain embodiments may constitute the primary sealing member between the wellbore and the environment. In some embodiments, the sealing member 52 may comprise a standard API ring type joint (RTJ) gasket, such as an API BX or RX ring gasket. In addition, the sealing member 52 may be made of any suitable material, which in some embodiments may be an appropriate metal material.

The primary sealing member 52 is typically positioned in an interface between the wellhead 14 and the connector body 16. For purposes of the present disclosure, an "interface" between the wellhead 14 and the connector body 16 may be considered to be the annular space defined between opposing surfaces of the wellhead and the connector body. In embodiments such as shown in FIG. 4, for instance, in which the connector assembly 10 is secured directly to the upper end portion 38 of the wellhead 14, the interface between the wellhead and the connector body 16 is the annular space between the upper end portion 38 of the wellhead and the connector body. In embodiments such as shown in FIG. 1, in which the connector assembly 10 is secured to a swivel ring 40 or other component which in turn is secured to the upper end portion 38 of the wellhead 14, the interface between the wellhead and the connector body 16 may also include the annular space between the swivel ring or other component and the connector body.

Referring again to FIG. 5, it may be seen that the sealing member 52 divides the interface between the wellhead 14 and the connector body 16 into an inner side 54 and an outer side 56. The inner side 54 of the interface is the side which, ignoring any secondary or backup seals between the wellhead 14 and the connector body 16, is in fluid communication with the wellbore (which in this case is connected to the wellhead bore 26 and the connector bore 22). The outer side 56 of the interface is the side which, ignoring any secondary or backup seals between the wellhead 14 and the connector body 16 or between the swivel ring 40 or other component and the connector body, is in fluid communication with the environment.

Figure 5A:
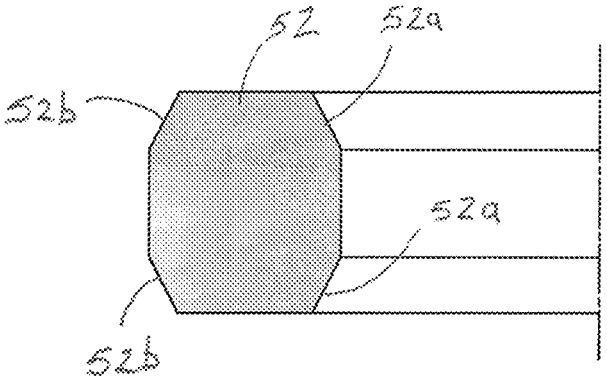
FIG. 5A is an enlarged cross-sectional representation of the sealing member shown in FIG. 5.

In certain embodiments the sealing member 52 may be positioned in opposing first and second circular seal grooves 58, 60 formed in the first and second contact surfaces 44, 46, respectively, coaxially with the connector bore 22. As shown best in FIG. 5, in some embodiments each seal groove 58, 60 may comprise a trapezoidal cross-sectional configuration having a radially inner inclined sealing surface 58*a*, 60*a* and a radially outer inclined sealing surface 58*b*, 60*b*. In this embodiment, and with reference to FIG. 5A, which is an isolated cross-sectional view of the sealing member 52, the sealing member may comprise a pair of radially inner sealing portions 52*a* which are configured to seal against the inner inclined sealing surfaces 58*a*, 60*a*, and a pair of radially outer sealing portions 52*b* which are configured to seal against the radially outer inclined sealing surfaces 58*b*, 60*b*. Further, in certain embodiments the sealing member 52 may be configured such that the inner and outer sealing portions 52*a*, 52*b* are mechanically energized against their corresponding sealing surfaces when the connector assembly 10 is secured to the wellhead 14.

As discussed above, once the connector assembly is connected to the wellhead, the primary sealing member between the connector assembly and the wellhead should be pressure tested before the BOP and any equipment connected to the top of the BOP is exposed to wellbore pressure. In many instances, the primary sealing member is pressure tested by applying a test pressure to the wellbore side of the seal. In this regard, the "wellbore side" of the seal is the side which is exposed to wellbore pressure, that is, the side which is exposed to the inner side of the interface between the wellhead and the connector body. In the example of the sealing member 52 described above, for instance, the wellbore side of the seal is the side which is exposed to the inner side 54 of the interface between the wellhead 14 and the connector body 16.

Pressure testing the wellbore side of the primary sealing member provides an accurate indication of whether the seal is capable of containing the expected wellbore pressures. However, pressure testing the wellbore side of the seal usually requires that the wellbore (or at least the connector bore) be pressurized up to the required test pressure. This is normally accomplished by first installing a BOP plug in the wellhead bore below the connector assembly, sealing the BOP bore above the connector assembly, and then pressurizing the connector bore to a predetermined level, usually through a test port in the BOP. However, installing a BOP plug in the wellhead bore in preparation for the pressure test takes time, which increases operating costs.

In accordance with certain embodiments of the present disclosure, the connector assembly 10 is configured to permit the sealing member 52 to be pressure tested by applying a test pressure to the "exterior side" of the sealing member, that is, the side of the sealing member which is exposed to the outer side 56 of the interface between the wellhead 14 and the connector body 16. In the embodiments shown in FIGS. 1-5, this is the side of the sealing member 52 on which the radially outer sealing portions 52*b* sealingly engage the radially outer inclined sealing surfaces 58*b*, 60*b* of the seal grooves 58, 60. Pressure testing the sealing member 52 in this manner obviates the need to pressure test the sealing member from the wellbore side of the sealing member. Thus, the pressure test does not require the wellbore to be pressurized. As a result, no need exists to install a BOP plug in the wellhead bore 26 in preparation for the pressure test, which in turn saves time and reduces operating costs.

Thus, in accordance with some embodiments of the present disclosure, the connector assembly 10 may include one or more test ports for testing the pressure integrity of the primary sealing member 52 from the exterior side of the sealing member. As shown in FIGS. 1-5, for example, the connector assembly 10 may include one or more test ports 62 which extend through the connector body 16 from an outer surface of the connector body to the outer side 56 of the interface between the wellhead 14 and the connector body. In embodiments in which the primary sealing member 52 is positioned against the shoulder 48, the connector assembly 10 may include one or more test ports which extend through the connector body 16 to the recess 36. In certain embodiments, each test port 62 may comprise a first end 64 which intersects the outer surface of the connector body 16 and a second end 66 which intersects the recess 36. In particular embodiments, the second end 66 of the test port 62 may be located adjacent to the shoulder 48. Thus, when the connector assembly 10 is secured to the wellhead 14, the test ports 62 will be in fluid communication with the exterior side of the primary sealing member 52. As shown in the drawings, each test port 62 may be closed with a corresponding plug 68 when not in use.

In certain embodiments, the connector assembly 10 may also include a suitable secondary sealing member 70 positioned in the outer side 56 of the interface between the wellhead 14 and the connector body 16. In this case, the second end 66 of each test port 62 may be located between the primary sealing member 52 and the secondary sealing member 70. During pressure testing of the primary sealing member 52, the secondary sealing member 70 will seal against the swivel ring 40 (as shown in FIG. 1) or the upper end portion 38 of the wellhead 14 (as shown in FIG. 4) and contain the test pressure in the outer side 56 of the interface adjacent to the exterior side of the sealing member 52.

In the example shown in FIG. 1, the swivel ring 40 is shown to comprise a bleed port 72 which, when the connector assembly 10 is connected to the wellhead 14, extends to the outer side 56 of the interface between the wellhead 14 and the connector body 16 (see FIG. 5). The bleed port 72 facilitates communication of the test pressure to the outer side 56 of the interface and allows the test pressure to be bled from the outer side once the pressure test has been completed. During the pressure test, the bleed port 72 may be sealed by a plug 74. The bleed port 72 does not form part of the present disclosure, and in fact no bleed port is included in the example shown in FIG. 4.

In accordance with one embodiment of the present disclosure, the primary sealing member 52 may be pressure tested by first connecting the connector assembly 10 to the wellhead 14, connecting one or more of the test ports 62 to a source of test pressure, applying a predetermined test pressure to the exterior side of the primary sealing member for a predetermined period of time, and then monitoring the test pressure. If the test pressure does not drop below a predetermined level, then the primary sealing member 52 can be considered to have passed the pressure test. If the test pressure drops below a predetermined level, then the primary sealing member 52 can be considered to have failed the pressure test. In accordance with this method, therefore, no need exists to install a BOP test plug in the wellhead bore 26 and pressurize the connector bore 22 in order to pressure test the primary sealing member 52.

Figure 6:
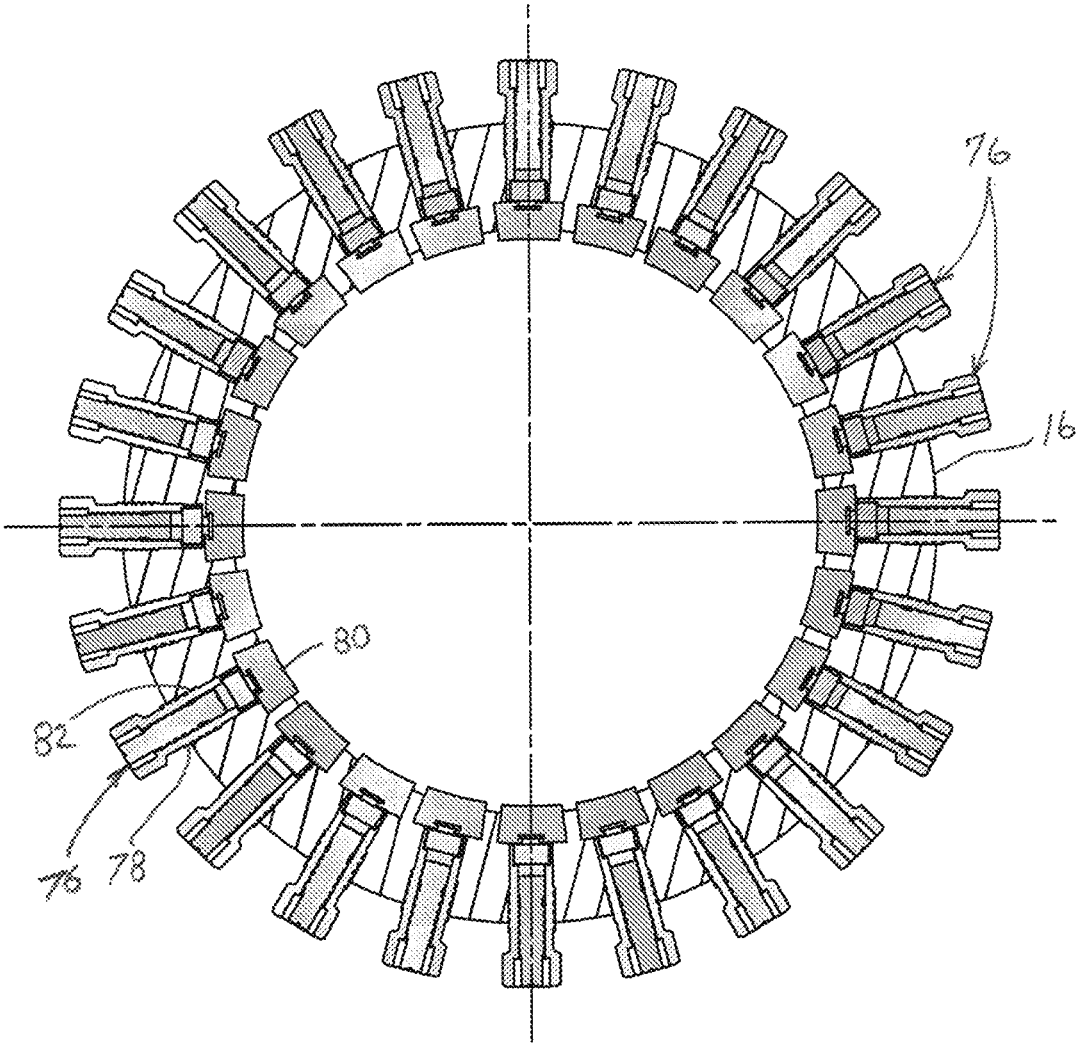
FIG. 6 is a cross-sectional representation of the connector assembly of FIG. 3 taken along line 6-6.

The connector assembly 10 may be releasably secured to the wellhead 14 using any appropriate means. In the illustrative embodiment shown in FIG. 1-5, for example, the connector assembly 10 is releasably secured to the wellhead 14 using a plurality of locking assemblies 76. The connector assembly 10 may comprise any number of locking assemblies 76 for this purpose. As shown in FIG. 6 for example, which is a cross-sectional view of the connector assembly 10 taken along line 6-6 in FIG. 3, in certain embodiments the connector assembly 10 may comprise twenty-four locking assemblies 76 spaced evenly around the circumference of the connector body 16. However, the connector assembly 10 could have more or fewer locking assemblies 76.

Figure 7:
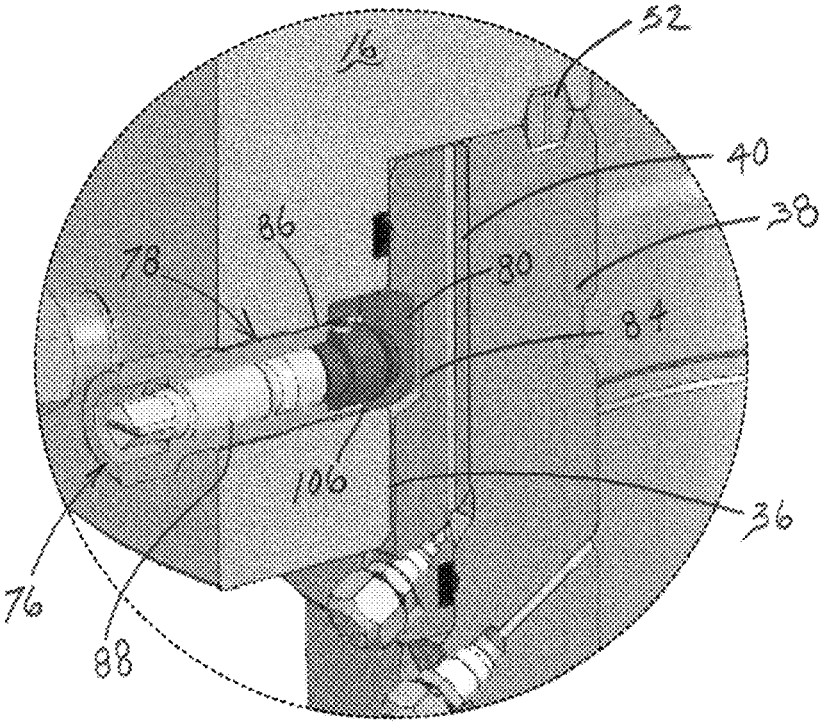
FIG. 7 is an enlarged view of the portion of FIG. 2 designated "B"

Referring also to FIG. 7, which is an enlarged view of the portion of FIG. 2 designated "B", in certain embodiments each locking assembly 76 may comprise a screw assembly 78 and a locking segment 80. Each screw assembly 78 is disposed in a corresponding through hole 82 which extends radially through the connector body 16 and may in certain embodiments be threaded. Each locking segment 80 is operatively engaged by its respective screw assembly 78 and is configured to engage a locking profile 84 on the wellhead 14. In some embodiments the locking profile 84 may take the form of an annular locking groove which is formed concentrically with the axis of the upper end portion 38 of the wellhead 14. Whatever its form, the locking profile/locking groove 84 ideally should be arranged at a fixed axial position relative to the wellhead. In embodiments such as shown in FIG. 1, in which a swivel ring 40 or other component is connected to the upper end portion 38 of the wellhead 14, the locking groove 84 may be formed in the outer diameter surface of the swivel ring. In embodiments such as shown in FIG. 4, in which no swivel ring or other component is connected to the upper end portion 38, the locking groove 84 may be formed in the outer diameter surface of the upper end portion.

As discussed above, the connector assembly should be secured to the wellhead with sufficient force to both mechanically energize the typically metal primary sealing member between the connector assembly and the wellhead and rigidize the connection (that is, preload the locking segments against the locking groove) so that the connection is able to withstand the often significant bending forces generated by the equipment connected to the top of the connector assembly. In certain prior art connector assemblies which are secured to the wellhead using a plurality of locking screws, in order to drive corresponding locking segments into a locking profile on the wellhead, significant torque must be applied to the locking screws to generate the force required to drive the locking segments into the fully locked position (i.e., the position in which the sealing member is fully energized and the locking segments are preloaded to the desired extent). Because of this, powered torque drivers or impact wrenches are often required to secure the connector assembly to the wellhead. However, these tools are sometimes not available in the field when the connection needs to be made up. As a result, significant time can be lost in procuring the proper tools to make up the connection.

In accordance with certain embodiments of the present disclosure, the locking assembly 76 may employ a screw assembly 78 comprising tandem-acting lock screws capable of generating, in two stages, the force required to drive the locking segments 80 into the fully locked position using less torque than is typically required by a single lock screw. Thus, no special power tools are required to secure the connector assembly 10 to the wellhead 14. Instead, the connector assembly 10 can be secured to the wellhead 14 using readily available hand tools, such as torque wrenches.

Figure 8:
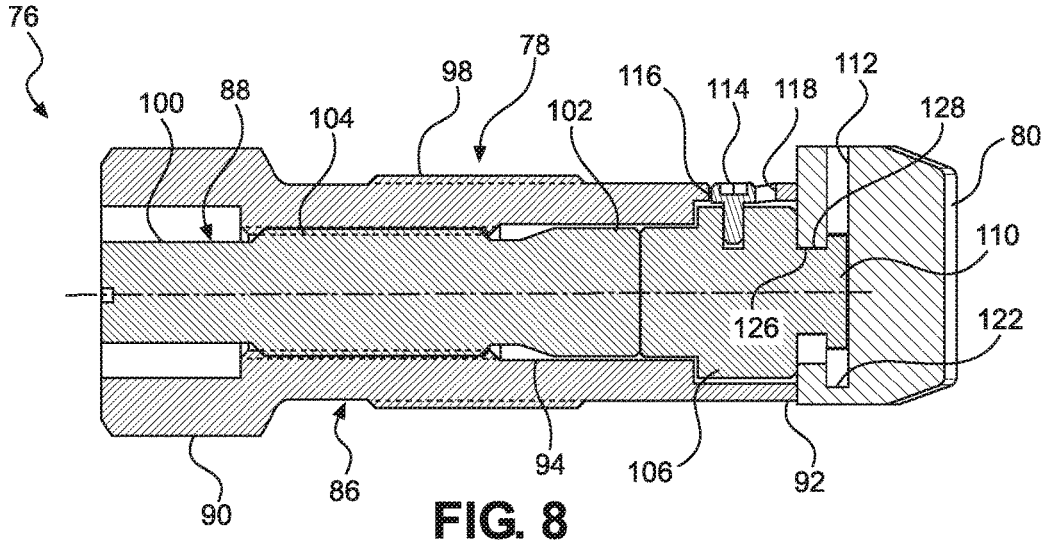
FIG. 8 is a cross-sectional representation of one embodiment of the locking assembly component of the connector assembly of the present disclosure.
Figure 9:
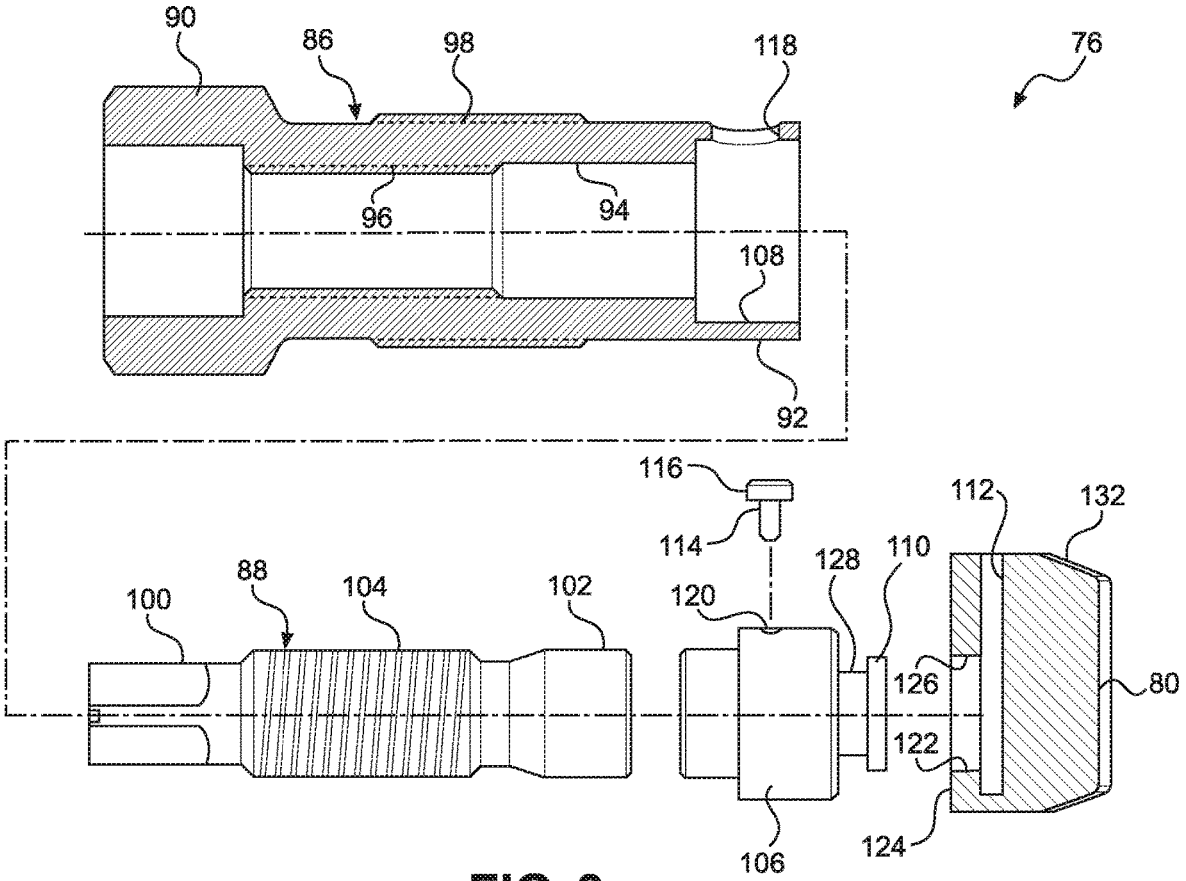
FIG. 9 is an exploded view of the locking assembly shown in FIG. 8.
Figure 10:
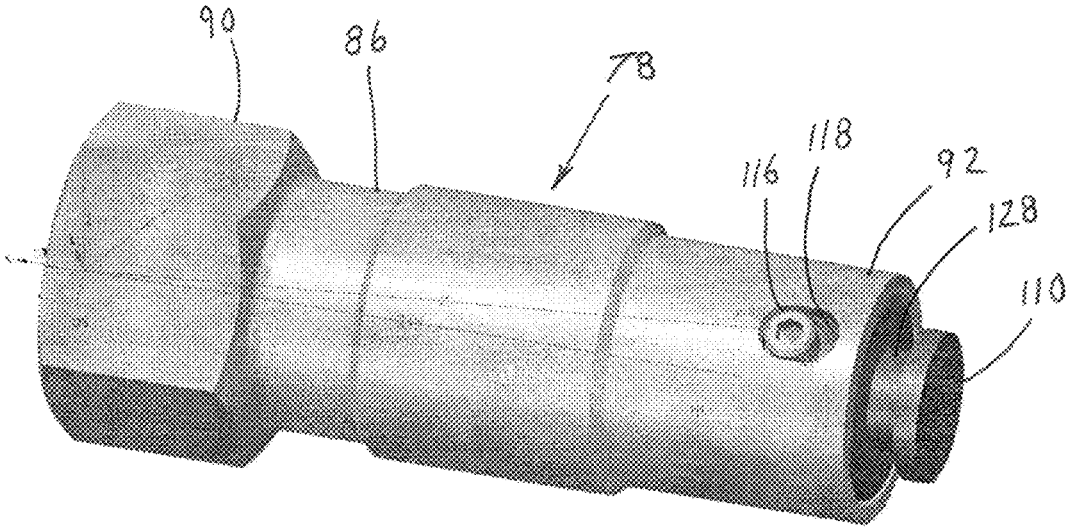
FIG. 10 is a perspective view of the locking assembly shown in FIG. 8, with the locking segment component of the locking assembly omitted for clarity.

Referring to FIGS. 8-10, in some embodiments the screw assembly 78 may comprise a tubular outer lock screw 86 (sometimes referred to as a stuffing box screw) positioned coaxially in the through hole 82 and a smaller diameter inner lock screw 88 positioned coaxially in the outer lock screw. As will be made apparent below, the outer and inner lock screws 86, 88 are each operatively engaged with the locking segment 80 such that axial translation of either the outer or inner lock screw radially inwardly relative to the connector body 16 will result in movement of the locking segment radially inwardly relative to the locking groove 84.

In accordance with some embodiments, the outer lock screw 86 may include a first or radially outer end 90, a second or radially inner end 92 which is located proximate the locking segment 80, a through bore 94 which extends axially between the first and second ends, an inner diameter threaded section 96 which is formed in the through bore, and an outer diameter threaded section 98 which is configured to be threadedly received in the through hole 82. Due to the threaded connection between the outer diameter threaded section 98 and the threaded through hole 82, rotation of the outer lock screw 86 will result in axial translation of the outer lock screw relative to the through hole 82 and, thus, the connector body 16. In some embodiments, the first end 90 may be configured to be engaged by a torque-applying tool. For example, the first end 90 may comprise a polygonal or other configuration for receiving a hand tool, such as a wrench or a socket.

In certain embodiments the inner lock screw 88 may include a first or radially outer end 100, a second or radially inner end 102, and an outer diameter threaded section 104 which is configured to be threadedly received in the inner diameter threaded section 96 of the outer lock screw 86. Due to the threaded connection between the outer diameter threaded section 104 of the inner lock screw 88 and the inner diameter threaded section 96 of the outer lock screw 86, rotation of the inner lock screw relative to the outer lock screw will result in axial translation of the inner lock screw relative to the outer lock screw. In some embodiments, the first end 100 may be configured to be engaged by a torque-applying tool. For example, the first end 10 may comprise a polygonal or other configuration for receiving a hand tool, such as a wrench or a socket.

The inner lock screw 88 may in certain embodiments be operatively engaged with the locking segment 80 through a retainer member 106 having a radially inner end which is engaged with the locking segment. In one example, the retainer member 106 may be positioned in the through bore 94 of the outer lock screw 86 between the radially inner end 102 of the inner lock screw 88 and the locking segment 80. In this manner, axial translation of the inner lock screw 88 relative to the outer lock screw 86 will result in movement of the retainer member 106 and, thus, the locking segment 80 radially inwardly relative to the locking groove 84. In some embodiments, at least a portion of the retainer member 106 may be slidably received in a corresponding recess 108 formed in the second end 92 of the outer lock screw 86. In addition, the retainer member 106 may in certain embodiments be connected to the locking segment 80 through, e.g., a key and slot arrangement comprising a key 110 which extends axially from a radially inner end of the retainer 106 and a slot 112 which extends partially through the locking segment 80 generally transverse to the axis of the locking assembly 76.

In certain embodiments, the outer lock screw 86 may be axially movably connected to the locking segment 80 through the retainer 106. For example, the retainer 106 may be axially movably connected to the outer lock screw 86 by a set screw 114 or similar means. The set screw 114 extends transversely into the retainer 106 and includes a head 116 which, when the retainer is assembled with the outer lock screw 86, is positioned in an oblong aperture 118 formed in the second end 92 of the outer lock screw. As shown best in FIG. 10, the aperture 118 has a long axis which is longer than the diameter of the head 116 and is oriented parallel to the axis of the outer lock screw 86. In use, engagement of the head 116 with the aperture 118 will allow axial movement of the retainer 106 relative to the outer lock screw 86 but restrict relative rotation between these components.

As illustrated best in FIGS. 8 and 9, each locking assembly 76 may be assembled by first inserting the retainer 106 into the recess 108 in the outer lock screw 86, then threading the set screw 114 into a corresponding hole 120 in the retainer, and then threading the inner lock screw 88 into the through bore 94 of the outer lock screw until the second end 102 of the inner lock screw contacts the retainer. This assembly may then be threaded into its corresponding through hole 82 in the connector body 16 until the key 110 protrudes into the recess 36 a sufficient distance to enable the locking segment 80 to be connected to the key.

At this point, the locking segment 80 may be lifted into the recess 36 and maneuvered so that the key 110 is inserted through an eye 122 which extends through a radially outer side 124 of the locking segment and connects to the slot 112. Once the key 110 is located in the slot 112, the locking segment 80 may be lowered until an upper side portion 126 of the slot engages a reduced diameter shoulder 128 that connects the key 110 to the radially inner end of the retainer 106.

Figure 11:
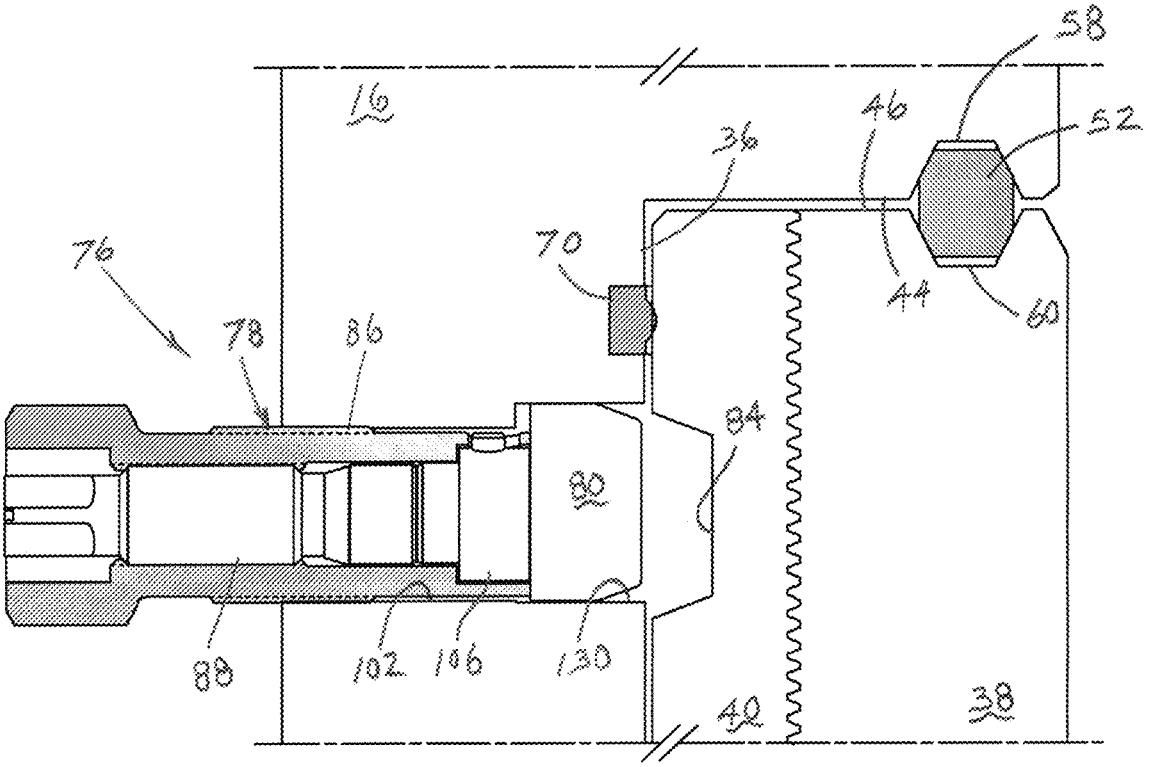
FIGS. 11-13 are a sequence of enlarged cross-sectional representations of the locking assembly of FIG. 8 being used to secure the connector assembly of FIG. 1 to the second hydrocarbon production system component.

Referring also to FIG. 11, after each locking assembly 76 has been assembled, the outer lock screw 86 may be unscrewed to retract the locking segment 80 into an annular groove 130 formed coaxially in the recess 36. The groove 130 may be configured to slidably receive the locking segments 80 as they move radially relative to the connector body 16 but prevent the locking segments from rotating relative to the axis of the locking assembly 76. As the outer lock screw 86 is being unscrewed, the aperture 118 will contact the head 116 of the set screw 114 and cause the retainer 106 to rotate with the outer lock screw while the key 110 rotates within the slot 112. Once the locking segments 80 have been fully retracted, they will be clear of the recess 36 and the connector assembly 10 may then be lowered onto the wellhead 14.

Figure 12:
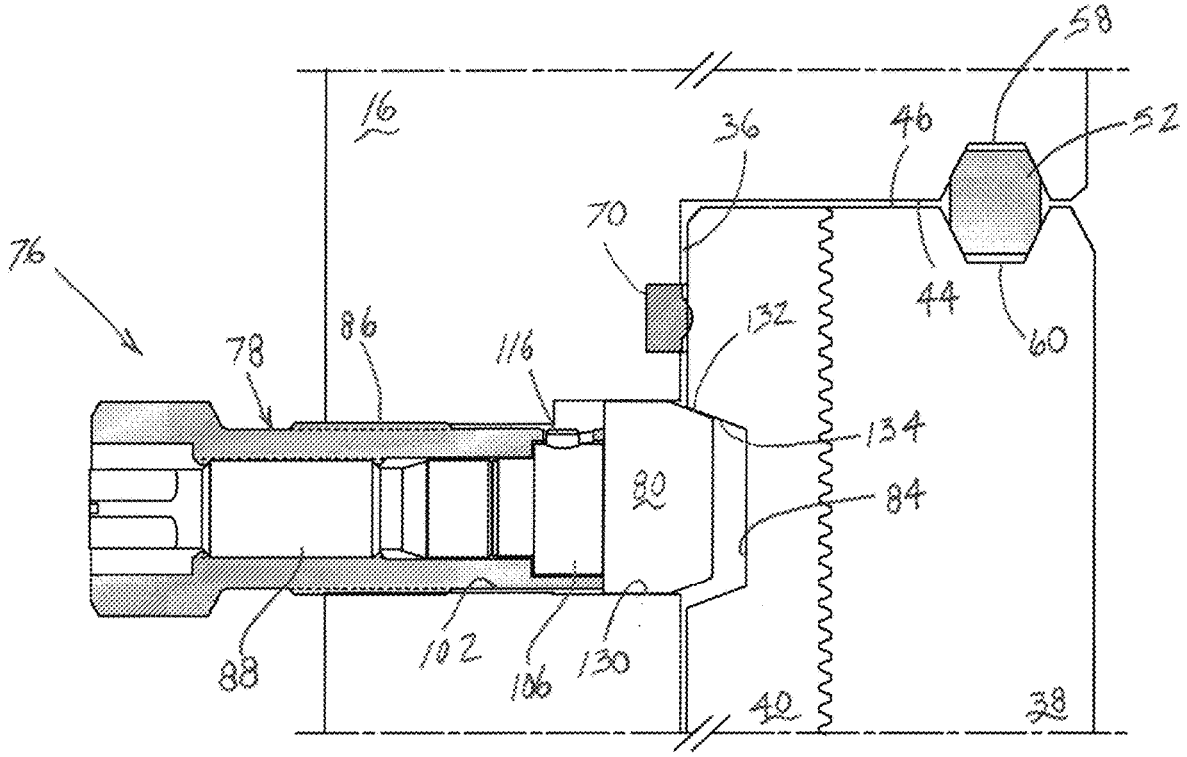

Before lowering the connector assembly 10 onto the wellhead 14, the sealing member 52 is positioned in the seal groove 60. The connector assembly 10 is then lowered onto the wellhead 14 until the connector body 16 lands on the upper end portion 38 of the wellhead. At this point, each outer lock screw 86 may be rotated (e.g., clockwise) to drive the screw assembly 78 radially inward relative to the connector body 16. During this step, the locking segment 80 will be driven a first distance into the locking groove 84 and, as shown in FIG. 12, an upward facing beveled surface 132 on the locking segment will slide along a downward facing inclined surface 134 of the locking groove to draw the connector body 16 against the wellhead 14 and at least partially energize the sealing member 52.

Figure 13:
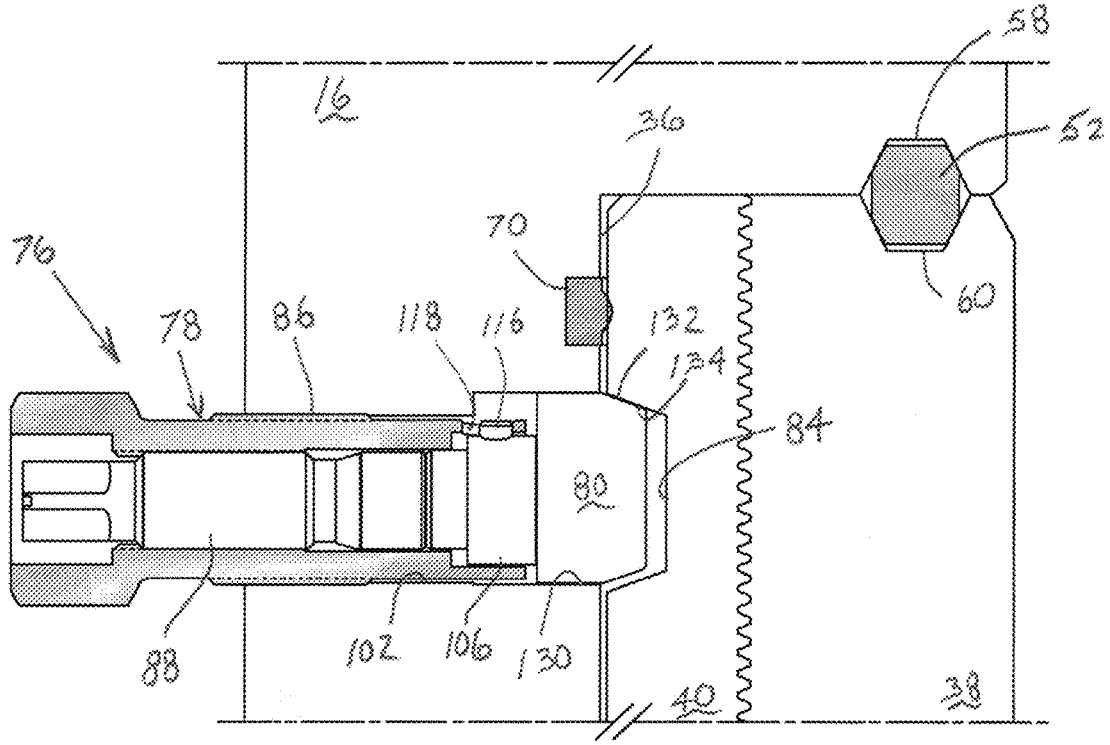

Referring to FIG. 13, after all the outer lock screws 86 have been torqued (e.g., to a predetermined torque value), each inner lock screw 88 is rotated to drive the retainer 106 radially inward relative to the outer lock screw until the head 116 of the set screw 114 engages the radially inner side of the aperture 118, or until the inner lock screw is torqued to a predetermined torque value. This will in turn force the locking segment 80 an additional second distance into the groove 84 and cause the beveled surface 132 to slide further along the inclined surface 134.

During this action, the torque applied to the second end 100 of the inner lock screw 88 will, due to the threaded connection between the inner and outer lock screws, generate an axial, radially inwardly directed connecting force on the locking segment 80 which will act through the surfaces 132, 134 and create a downward directed force on the locking segment. This downward directed force is transmitted to the connector body 16 through the retainer member 106 (via the shoulder 128) and the second end 92 of the outer lock screw 86 and will act to draw the connector body more tightly against the wellhead 14. This action will cause the first contact surface 44 on the connector body 16 to seat against the second contact surface 46 on the wellhead 14 and thereby fully energize the sealing member 52. Moreover, any additional torque applied to the inner lock screw 88 at this point will serve to preload the locking segments 80 against the locking groove 84 and thereby rigidize the connection.

The tandem acting outer and inner lock screws 86, 88 generate a substantial connecting force for securing the connector assembly 10 to the wellhead 14. As is understood by persons skilled in the art, the axial force generated by the inner lock screw 88 is inversely proportional to the diameter of the lock screw. Thus, for a given torque, the inner lock screw 88 is able to generate a greater connecting force than the outer lock screw 86. This mechanical advantage enables the required connecting force to be achieved without the need to apply relatively large torques to either the outer lock screw 86 or the inner lock screw 88. As a result, the primary sealing member 52 can be fully energized and the connection rigidized without the need for power tools such as torque drivers and impact wrenches.

Figure 14A:
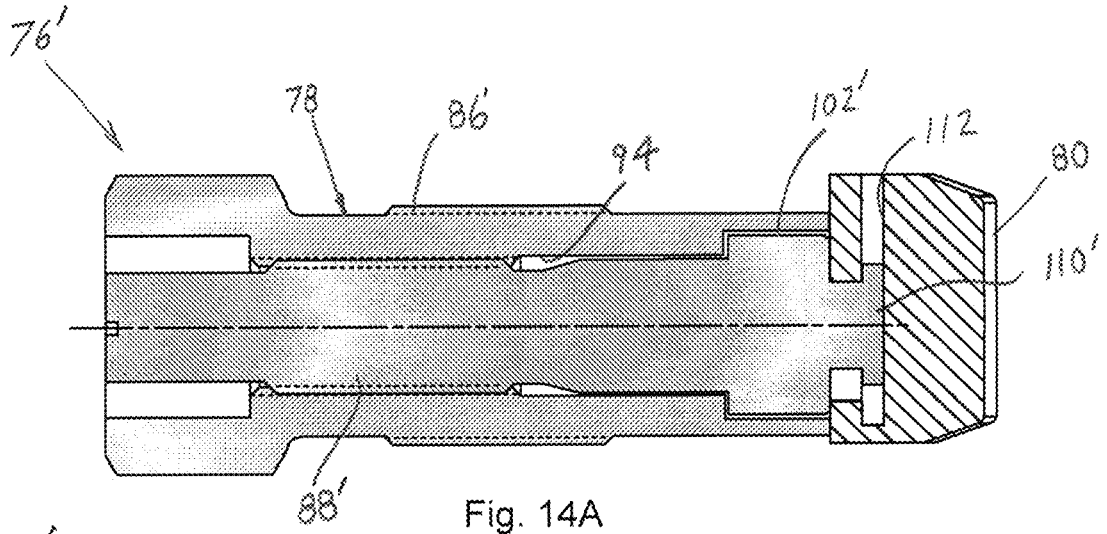
FIGS. 14A and 14B are cross-sectional representations of another embodiment of the locking assembly component of the connector assembly of the present disclosure.
Figure 14B:
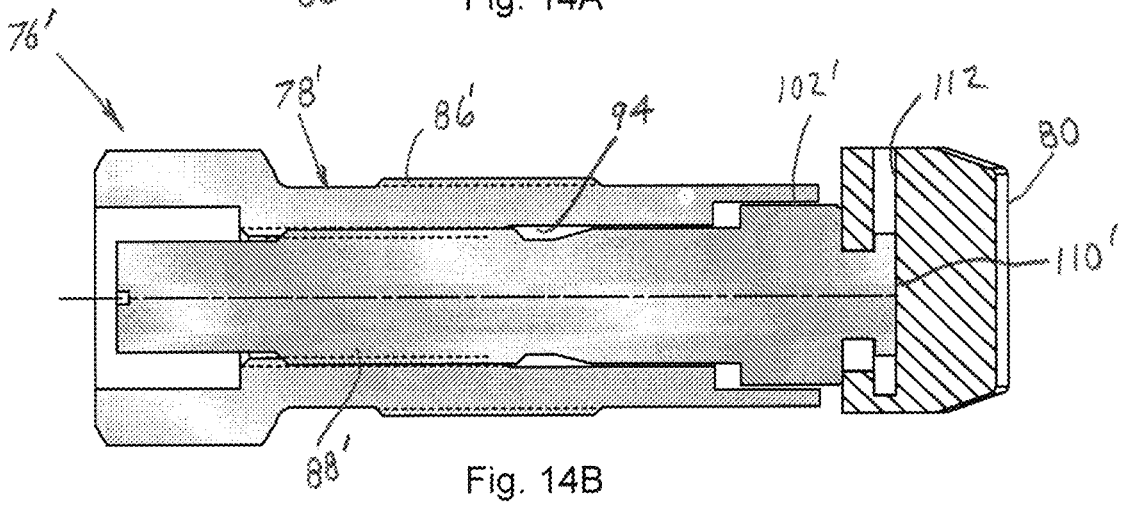
Figure 15:
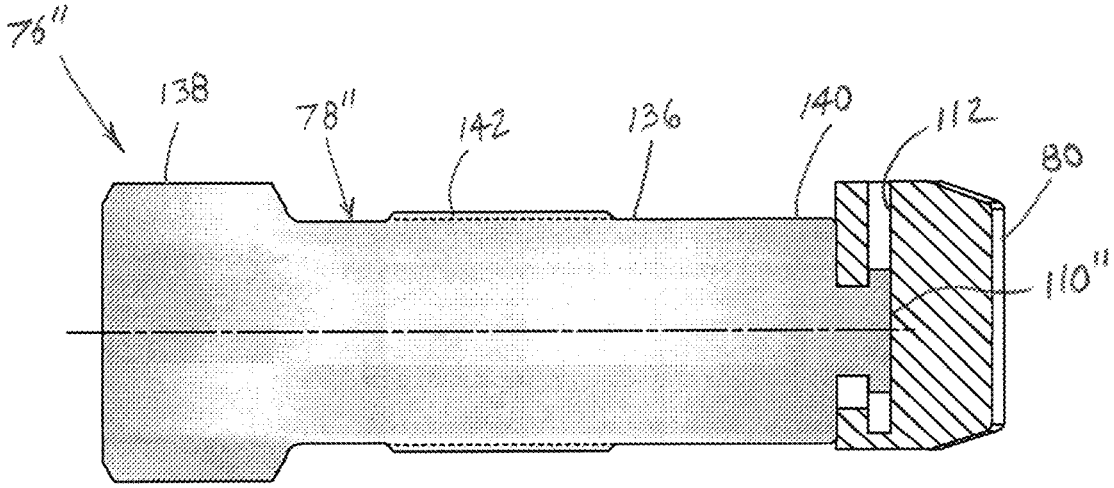
FIG. 15 is a cross-sectional representation of yet another embodiment of the locking assembly component of the connector assembly of the present disclosure.

Examples of alternative locking assembly embodiments which may be used in the various connector assembly embodiments of the present disclosure are illustrated in FIGS. 14 and 15.

A first alternative embodiment of the locking assembly is shown in FIGS. 14A and 14B. The locking assembly of this embodiment, which is indicated generally by reference number 76', is similar in many respects to the locking assembly 76 described above. Thus, the locking assembly 76' includes a screw assembly 78' having an outer lock screw 86' similar to the outer lock screw 86 described above, and a smaller diameter inner lock screw 88' which is threadedly received in the axial through bore 94 in the outer lock screw. In the present embodiment, however, the retainer member 106 is omitted. Instead, the inner lock screw 88' is operatively engaged with the locking segment 80 through direct contact. For example, the inner lock screw 88' may include a second end 102' which is connected to the locking segment 80 by a key and slot arrangement comprising a key 110' which extends axially from the second end and is received in the slot 112 in the locking segment.

Operation of the locking assembly 76' is similar to the operation of the locking assembly 76. First, the outer lock screw 86' is rotated to move the locking segment 80 a first distance into the locking profile 84. Then, as shown in FIG. 4B, the inner lock screw 88' is rotated within the outer lock screw 86' to move the locking segment 80 an additional second distance into the locking profile 84 in order to fully energize the sealing member 52 and rigidize the connection. The advantage of this embodiment is that the locking assembly 76' has fewer parts, thus making it easier to assemble and less likely to fail.

A second alternative embodiment of the locking assembly is shown in FIG. 15. The locking assembly of this embodiment, which is indicated generally by reference number 76", includes a screw assembly 78" comprising a single lock screw 136. The lock screw 136 includes a first or outer end 138, which may comprise a polygonal or other configuration for receiving a hand tool, such as a wrench or socket, a second or inner end 140 which is located proximate the locking segment 80, and an outer diameter threaded section 142 which is configured to be threadedly received in the through hole 82 in the connector body 16. In this embodiment, the second end 140 is connected to the locking segment 80 by a key and slot arrangement comprising a key 110" which extends axially from the second end and is received in the slot 112 in the locking segment 80.

In operation, the lock screw 136 is rotated to move the locking segment 80 into the locking profile 84. The advantage of this embodiment is that the locking assembly 76" has fewer parts, thus making it easier to assemble and less likely to fail.

It should be recognized that, while the present disclosure has been presented with reference to certain embodiments, those skilled in the art may develop a wide variation of structural and operational details without departing from the principles of the disclosure. For example, the various elements shown in the different embodiments may be combined in a manner not illustrated above. Therefore, the following claims are to be construed to cover all equivalents falling within the true scope and spirit of the disclosure.

What is claimed is:

1. A connector assembly for securing a first hydrocarbon production system component to a second hydrocarbon production system component connected to a wellbore, the connector assembly comprising:

a tubular connector body having a first end which is connectable to the first component, an opposite second end, a connector bore which extends axially between the first and second ends, and a cylindrical recess which extends through the second end coaxially with the connector bore and is configured to receive an upper end portion of the second component;

a plurality of locking assemblies for securing the connector body to the second component, each locking assembly comprising:

a locking segment which is configured to engage a locking profile on the second component to thereby secure the connector body to the second component;

an outer lock screw which is threadedly received in a corresponding through hole in the connector body such that rotation of the outer lock screw in the through hole results in axial translation of the outer lock screw relative to the connector body, the outer lock screw comprising a radially outer first end, a radially inner second end, and a through bore which extends axially between the first and second ends, wherein the outer lock screw is operatively engaged with the locking segment such that axial translation of the outer lock screw radially inwardly relative to the connector body results in movement of the locking segment radially inwardly relative to the locking profile;

an inner lock screw which is threadedly received in the through bore in the outer lock screw such that rotation of the inner lock screw relative to the through bore results in axial translation of the inner lock screw relative to the outer lock screw, the inner lock screw comprising a radially outer first end and a radially inner second end, wherein the inner lock screw is operatively engaged with the locking segment such that axial translation of the inner lock screw radially inwardly relative to the outer lock screw results in movement of the locking segment radially inwardly relative to the locking profile;

wherein rotation of the outer lock screw relative to the through hole in the connector body operates to move the locking segment a first distance into the locking profile, and rotation of the inner lock screw relative to the through bore in the outer lock screw operates to move the locking segment an additional second distance into engagement with the locking profile.

2. The connector assembly of claim 1, wherein the inner lock screw is operatively engaged with the locking segment through a retainer member which is positioned between the second end of the inner lock screw and the locking segment.

3. The connector assembly of claim 2, wherein the retainer member is slidably received in a cylindrical recess formed in the second end of the outer lock screw.

4. The connector assembly of claim 2, wherein the retainer member is connected to the locking segment.

5. The connector assembly of claim 4, wherein the retainer member is connected to the locking segment by a slot and key arrangement comprising a key which extends axially from a radially inner end of the retainer member and a slot which extends partially through the locking segment generally transverse to the axis of the locking assembly.

6. The connector assembly of claim 4, wherein the retainer member is axially movably connected to the outer lock screw.

7. The connector assembly of claim 6, wherein the retainer member is axially movably connected to the outer lock screw with a set screw secured to the retainer, the set screw comprising a head which, when the retainer is assembled with the outer lock screw, is positioned in an oblong aperture formed in the second end of the outer lock screw, the aperture comprising a long axis which is longer than a diameter of the head and is oriented parallel to the axis of the outer lock screw, wherein engagement of the head with the aperture allows axial movement of the retainer relative to the outer lock screw but restricts relative rotation of the retainer relative to the outer lock screw.

8. The connector assembly of claim 1, wherein the second end of the inner lock screw is connected to the retainer member.

9. The connector assembly of claim 8, wherein the second end of the inner lock screw is connected to the locking segment by a slot and key arrangement comprising a key which extends axially from the second end of the inner lock screw and a slot which extends partially through the locking segment generally transverse to the axis of the locking assembly.

10. A method for securing a first hydrocarbon production system component to a second hydrocarbon production system component connected to a wellbore, the method comprising:

providing a connector assembly having a tubular connector body, a plurality of locking segments which are radially slidably supported on the connector body, a plurality of outer lock screws which are each received in a corresponding radially extending through hole in the connector body, and a plurality of inner lock screws which are each received in an axial through bore in a corresponding outer lock screw;

connecting a first end of the connector body to the first component;

positioning a second end of the connector body over an upper end portion of the second component; and moving each locking segment into a locking profile on the second component to thereby secure the connector body to the second component;

wherein the step of moving each locking segment into the locking profile comprises first moving the outer lock screw axially radially inwardly relative to the through hole to thereby move the locking segment a first distance into engagement with the locking profile, and then moving the inner lock screw axially radially inwardly relative to the outer lock screw to thereby move the locking segment an additional second distance into engagement with the locking profile.

11. The method of claim 10, wherein each outer lock screw is threadedly received in its corresponding through hole such that rotation of the outer lock screw in the through hole results in axial translation of the outer lock screw relative to the connector body, and wherein each inner lock screw is threadedly received in its corresponding through bore such that rotation of the inner lock screw relative to the through bore results in axial translation of the inner lock screw relative to the outer lock screw.

12. The method of claim 11, wherein each inner lock screw is operatively engaged with its corresponding locking segment through a retainer member positioned in the through bore between a radially inner end of the inner lock screw and the locking segment.

13. The method of claim 12, wherein each retainer member is connected to its corresponding locking segment.

14. The method of claim 13, wherein each retainer member is axially movably connected to its corresponding outer lock screw.

15. The method of claim 14, wherein the retainer member is axially movably connected to the outer lock screw using a set screw secured to the retainer, the set screw comprising a head which, when the retainer is assembled with the outer lock screw, is positioned in an oblong aperture formed in a radially inner end of the outer lock screw, the aperture comprising a long axis which is longer than a diameter of the head and is oriented parallel to the axis of the outer lock screw, wherein engagement of the head with the aperture allows axial movement of the retainer relative to the outer lock screw but restricts relative rotation of the retainer relative to the outer lock screw.

* * * * *